US007997179B1

(12) United States Patent
Nelson et al.

(10) Patent No.: US 7,997,179 B1
(45) Date of Patent: Aug. 16, 2011

(54) HYBRID WATER CANNON

(75) Inventors: David A. Nelson, Indian Head, MD (US); David Smith, Valley Falls, NY (US); Scott Strohman, King George, VA (US); Ken Poe, Welcome, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 666 days.

(21) Appl. No.: 12/082,193

(22) Filed: Apr. 1, 2008

(51) Int. Cl.
*F42B 33/00* (2006.01)

(52) U.S. Cl. ..... 86/50; 89/1.701; 181/110; 181/119; 367/144

(58) Field of Classification Search ..... 89/1.701; 181/110, 119, 120; 367/144; 86/50
See application file for complete search history.

(56) References Cited

U.S. PATENT DOCUMENTS

| | | | | |
|---|---|---|---|---|
| 1,108,714 | A | 8/1914 | Davis | |
| 3,784,103 | A * | 1/1974 | Cooley | 239/101 |
| 3,823,847 | A * | 7/1974 | Ware | 222/79 |
| 5,136,920 | A | 8/1992 | Breed et al. | |
| 5,515,767 | A | 5/1996 | Gilbert | |
| 5,785,038 | A | 7/1998 | Mattern | |
| 6,408,731 | B1 | 6/2002 | Elsener | |
| 6,439,127 | B1 | 8/2002 | Cherry | |
| 6,461,102 | B2 | 10/2002 | Sting et al. | |
| 6,490,957 | B1 | 12/2002 | Alexander et al. | |
| 6,595,103 | B1 | 7/2003 | Kathe | |
| 6,644,166 | B2 | 11/2003 | Alexander et al. | |
| 6,824,076 | B2 * | 11/2004 | Harris | 239/311 |
| 2005/0081706 | A1 | 4/2005 | Alford | |
| 2006/0011056 | A1 | 1/2006 | Edwards et al. | |
| 2006/0204384 | A1 * | 9/2006 | Cornell et al. | 417/423.5 |

FOREIGN PATENT DOCUMENTS

| | | |
|---|---|---|
| GB | 2299156 | 9/1996 |
| WO | WO03058155 | 7/2003 |

* cited by examiner

*Primary Examiner* — J. Woodrow Eldred
(74) *Attorney, Agent, or Firm* — Fredric J. Zimmerman

(57) ABSTRACT

A hybrid water cannon that can be configured in either a recoil mode or recoilless mode. A first barrel is attached to a breech block. Either a second barrel or breech plug is also attached to the breech block on a side opposite the first barrel. With the breech plug attached, the water cannon is in a recoil mode. With the second barrel attached, the water cannon is in a recoilless mode. A chamber containing a propellant charge is in communication with both the first and second barrels. Upon ignition, the propellant charge pushes a charge of water from both barrels simultaneously and in opposite directions. The discharge from the first barrel is used to disable the target ordnance. The discharge from the second barrel counters the recoil. The propellant charge is ignited using an ignition charge in a port intersecting the chamber at an angle other than 90 degrees.

6 Claims, 6 Drawing Sheets

HYBRID WATER CANNON

STATEMENT OF GOVERNMENT INTEREST

The invention described herein may be manufactured and used by or for the government of the United States of America for government purposes without the payment of any royalties thereon or thereof.

FIELD OF THE INVENTION

The present invention is directed to liquid disruptors and explosive disarming. In particular, the present invention relates to water cannons.

BACKGROUND OF THE INVENTION

Disruptors are used to disarm or to disable explosive devices. In general, the disrupter is deployed remotely from an explosive device and uses a projectile to disable the explosive device without initiating the explosive material contained in the device. One type of disruptor is a water cannon, which uses water as the projectile. In a water cannon, a charge of water is discharged from the cannon under high pressure or velocity using, for example, a propellant charge contained in the water cannon. The propellant charge, upon initiation, expands through the barrel of the water cannon, driving a plunger or similar assembly that pushes the charge of water contained in the barrel out through the end of the barrel, rupturing a membrane used to close the end of the barrel to retain the charge of water within the barrel. Water cannons produce a charge of water moving at very high velocity, high enough to disrupt an explosive device. This discharge of water, however, produces an equally forceful and violent recoil in the water cannon, necessitating a mounting structure of sufficient size and strength to compensate for this recoil. Such mounting structures eliminate the use of conventional water cannon as a tripod mounted device or small robotic platform held device.

Attempts have been made to reduce the recoil associated with water cannon. The desire to reduce recoil, however, is not limited to water cannons and can be found in other types of guns. For example, an aeroplane gun in a recoilless arrangement uses the powder gases in the gun to blow the barrel of the gun up through the top of the sleeve. The gun is expended along with the projectile at each shot. By this arrangement of having the gun and the projectile fly in opposite directions, comparatively small shock will be thrown on the framework of the aeroplane. Therefore, a single charge is used to produce substantially simultaneous and opposite forces to both launch a projectile and minimize the recoil associated with that launch. This device is widely known as the Davis gun, and the term Davis gun is often used to refer generally to any recoilless gun arrangement.

In another example, a device for firing a projectile for de-arming purposes includes a chamber in communication with the barrel. The chamber has a rear outlet through which material, in use, is ejected so as to counteract the recoil caused by firing the projectile. The material is expelled from the chamber through the outlet as a result of the explosion caused by the detonation of the charge. The chamber includes a piston interposed between the recoil absorbing material and each port. Both the material discharged rearwardly and the projectile can be water. When water is fired, the firing of the device ejects a single pulse of water followed by the projectile. The gas that expels the counteracting material is initially directed forwarded and has to be re-routed rearwardly to the chamber to expel the material. Therefore, an arrangement of passages to redirect the gas is required. Moreover, a portion of the force of the gas will be lost as its direction is reversed.

Similarly, another de-armer uses a single charge to move plugs to discharge water simultaneously in different directions. The igniter is formed integral with the rear discharge system which is axially disposed around the igniter. The force from the explosion moves forward initially and is then directed to the rear through one or more ports. The arrangements of these water cannons provide for water charges that are arranged as annular rings around the main barrel or the igniter. The gas from the propellant charge moves through or toward the main barrel initially, and a portion of the expanding gases are redirected through channels to a rearward direction.

SUMMARY OF THE INVENTION

The present invention is directed to a hybrid water cannon that can be interchangeably operated in either a recoil mode or a recoilless mode. In general, the water cannon uses a charge of an energetic material to drive a plug and a charge of water through a barrel. In the recoilless mode, the water cannon is arranged symmetrically with two barrels extending in opposite directions from a single chamber or breech ring. A charge of energetic material simultaneously drives water charges through the two barrels, creating substantially equal and opposing forces that cancel each other and eliminate recoil. In the recoil mode, one of the barrels is removed and a breech plug is inserted. In addition, the angle of the black powder port in the chamber is not perpendicular to the main charge but is at some angle other than 90 degrees.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
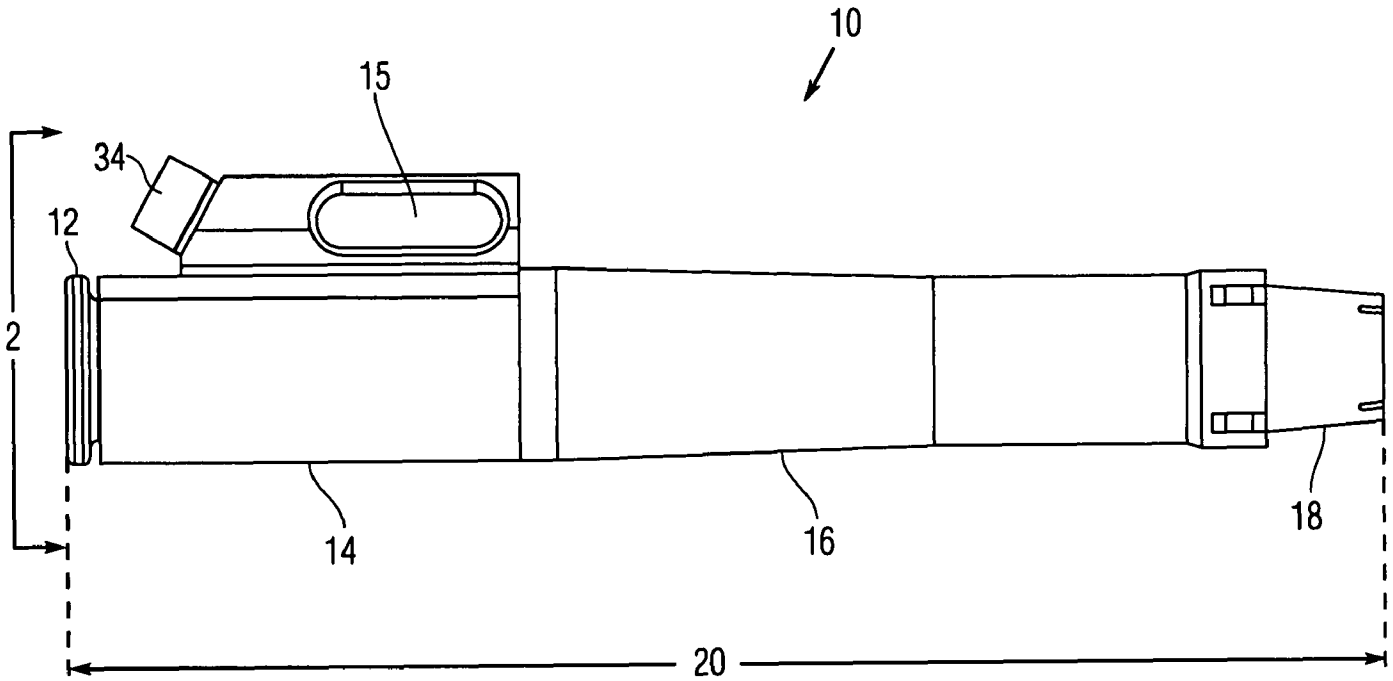
FIG. 1 is a side view of one embodiment of a water cannon in accordance with the present invention.
Figure 2:
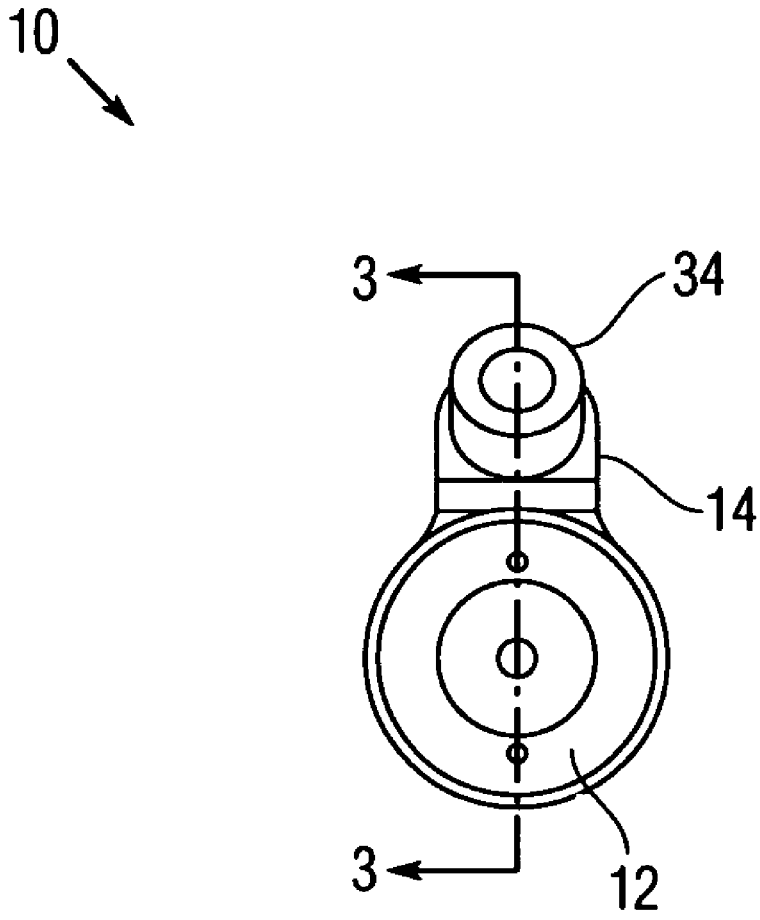
FIG. 2 is a view through line 2-2 of FIG. 1.

Exemplary embodiments of water cannon in accordance with the present invention include arrangements with and without recoil. More particularly, the water cannon are hybrid water cannon or a water cannon system, capable of being arranged with or without recoil. Referring initially to FIGS. 1 and 2, an exemplary embodiment of a water cannon 10 in accordance with the present invention is illustrated. As illustrated, the water cannon is arranged in a recoil mode. The water cannon includes a breech block 14. The breech block includes handle 15 for holding and transporting the water cannon. In one embodiment, the water cannon 10 also includes a first barrel 16 attached to the breech block and extending from the breech block in a first direction. Suitable lengths for the first barrel are from about 17 inches up to about 20 inches. Attached to one end of the first barrel opposite the breech block is a first nozzle 18. The nozzle constricts the ejecting water and forms a cohesive water jet used for disruption of the intended target or targets. Also in communication with the breech block opposite the first barrel is a breech plug 12. Suitable materials for the breech block, breech plug, barrels and nozzles include, but are not limited to, 4340 steel. In accordance with this embodiment, the water cannon has an overall length 20 of about 25 to about 27 inches.

Figure 3:
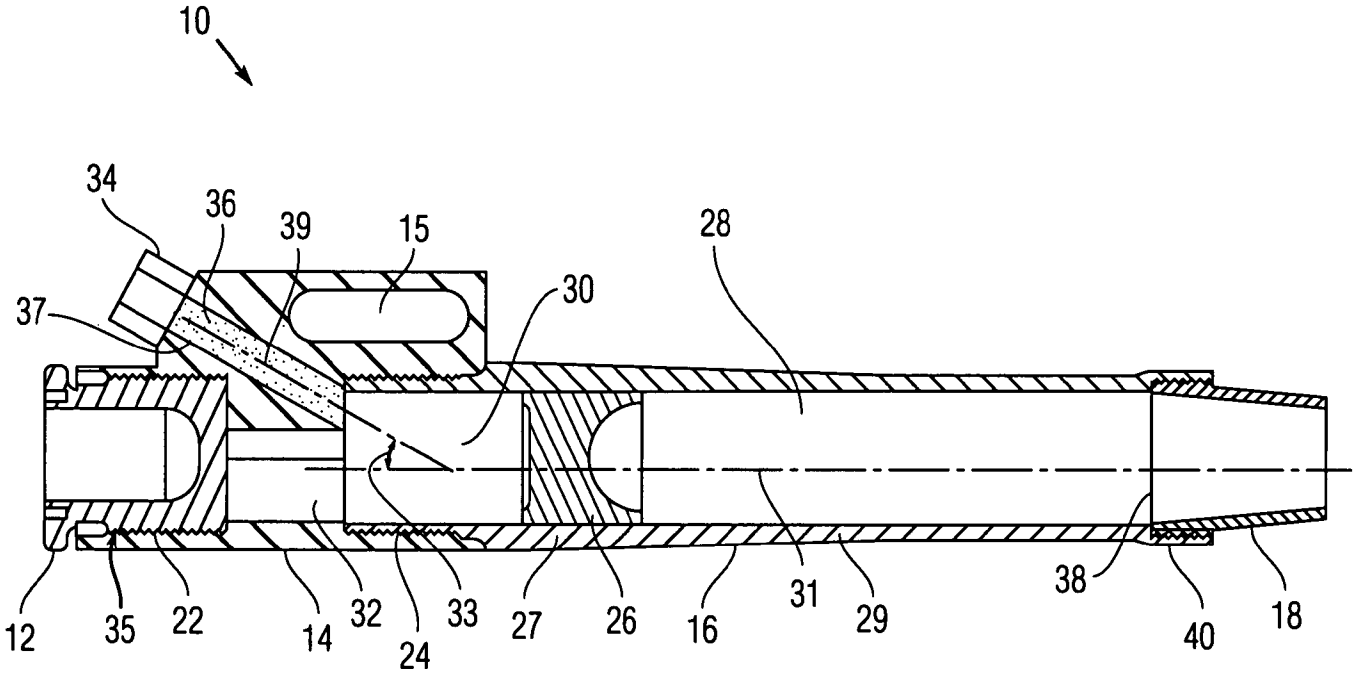
FIG. 3 is a view through line 3-3 of FIG. 2.

Referring to FIG. 3, the first barrel 16 includes a first cylindrical bore 29 running the length of the barrel. This first cylindrical bore includes a first charge of water 28, which is the projectile that the water cannon uses to disable a bomb or ordnance. The water cannon includes a chamber 30 in communication with the first cylindrical bore. The chamber is sized to hold the desired amount of energetic material to expel the first charge of water from the first barrel upon ignition. In one embodiment, the charge of energetic material contained within the chamber is arranged as one or more powder bags. Suitable arrangements of powder bags and energetic materials include, but are not limited to, aluminum mylar bags containing gunpowder. The chamber can be disposed in the breech block, the first barrel or both the first barrel and the breech plug 12. As illustrated, the chamber is a portion of the first barrel, and that portion is inserted within the breech block 14.

Also disposed within the first cylindrical bore 29 is pusher plug assembly 26. The pusher plug assembly is disposed within the first cylindrical bore between the chamber 30 and the first charge of water 28. Upon ignition of the energetic materials, the pusher plug assembly is pushed along the length of the first barrel 16 to expel the first charge of water from the end of the first barrel through the first nozzle 18. The pusher plug assembly is generally cylindrical in shape to fit the contours of the first cylindrical bore and includes an O-ring 27 to make an adequate seal between the walls of the first cylindrical bore and the pusher plug assembly. This seal is adequate to prevent the first charge of water from leaking past the pusher plug assembly. The pusher plug deformation (upon ignition) prevents expanding gases from the ignition of the energetic material from by-passing the pusher plug assembly. Suitable materials for the pusher plug assembly include, but are not limited to, high elongation high density polyethylene (HDPE). The pusher plug has concave elements on the leading and trailing faces that maximize the water volume and chamber volume providing good sealing and obturation and preventing plug breakup.

In order to hold the first charge of water 28 within the first barrel 16, a first diaphragm 38 is provided between the first barrel and the first nozzle 18. Suitable materials for the first diaphragm include, but are not limited to, elastomers such as rubber. The first diaphragm is ruptured by the first charge of water as that charge of water is expelled from the first barrel.

Extending through the breech block 14 from the chamber 30 in a direction opposite the first direction is a passage 32. The passage extends through the breech block to an opening 35 in the breech block opposite the first barrel 16. Therefore, the opening is in communication with the chamber, and upon ignition of the energetic material in the chamber, the expanding ignition gases are expelled simultaneously and directly in opposite directions through the first barrel and through the passage to the opening. The flow of expanding ignition gases do not have to be redirected to routed through narrow passages. The breach plug 12 is disposed within the opening to prevent the expanding ignition gases from moving through the passage and escaping through the opening. As arranged, the water cannon, upon ignition of the energetic charges, expels the first charge of water 28 from the first barrel, producing a recoil. Therefore, in this embodiment, the water cannon 10 is supported in a structure sufficient to compensate for that recoil.

In order to provide for the ignition of the energetic materials in the chamber 30, the water cannon includes an ignition charge port 37 disposed in the breech block 14. In one embodiment, the ignition charge port is generally cylindrical in shape and intersects the chamber opposite the pusher plug assembly 26. The ignition charge port includes an ignition charge 36 that is used to ignite the main propellant charge of energetic material within the chamber. Suitable ignition charges include black powder. In one embodiment, the ignition charge port intersects the chamber at an angle other than 90 degrees. In particular, the central axis 39 of the generally cylindrical ignition charge port intersects the first central axis 31 of the generally cylindrical chamber, which in one embodiment is the central axis of the first cylindrical bore 29 of the first barrel 16, at an angle 33 other than 90 degrees. These angles reduce the stress concentration in the chamber. In one embodiment, the ignition charge port includes a threaded breach cap or closure 34.

In one embodiment, in order to provide for the assembly, disassembly, cleaning and configuring of the water cannon, the breech plug 12, first barrel 16 and first nozzle 18 are all releasably attached to each other. In one embodiment, a two part mechanical fastener 22 is disposed between the opening 35 in the breech block 14 and the breech plug. A first part of the two part mechanical fastener, for example a threaded female fitting, is disposed in the opening, and the corresponding second part of the two part mechanical fastener, the male threads, are disposed on the breech plug. Similarly, a two part mechanical fastener 24 is provided between the first barrel and the breech block. The breech block contains the first part of the two-part mechanical fastener, for example a threaded female fitting, and the first barrel contains the corresponding second part, a male thread. A two part mechanical fastener 40 is provided between the first nozzle and the first barrel. The first barrel includes the first part of the two-part mechanical fastener, for example a threaded female fitting, and the first nozzle contains the corresponding second part, a male thread.

In order to assemble the embodiment of the water cannon shown in FIGS. 1-3, the pusher plug assembly 26 is placed in the first cylindrical bore 29 at the desired position, and the first charge of water 28 is added. The first diaphragm 38 is added to the end of the first barrel 16, and the first nozzle 18 is threaded onto the end of the first barrel to hold the diaphragm in place. The charge of energetic material is then added to the other end of the first barrel, and the first barrel is threaded onto the breech block 14. The breech plug 12 is threaded into the opening 35 until fully sealed. The ignition material is then added to the ignition charge port 37 of the breech block.

Figure 4:
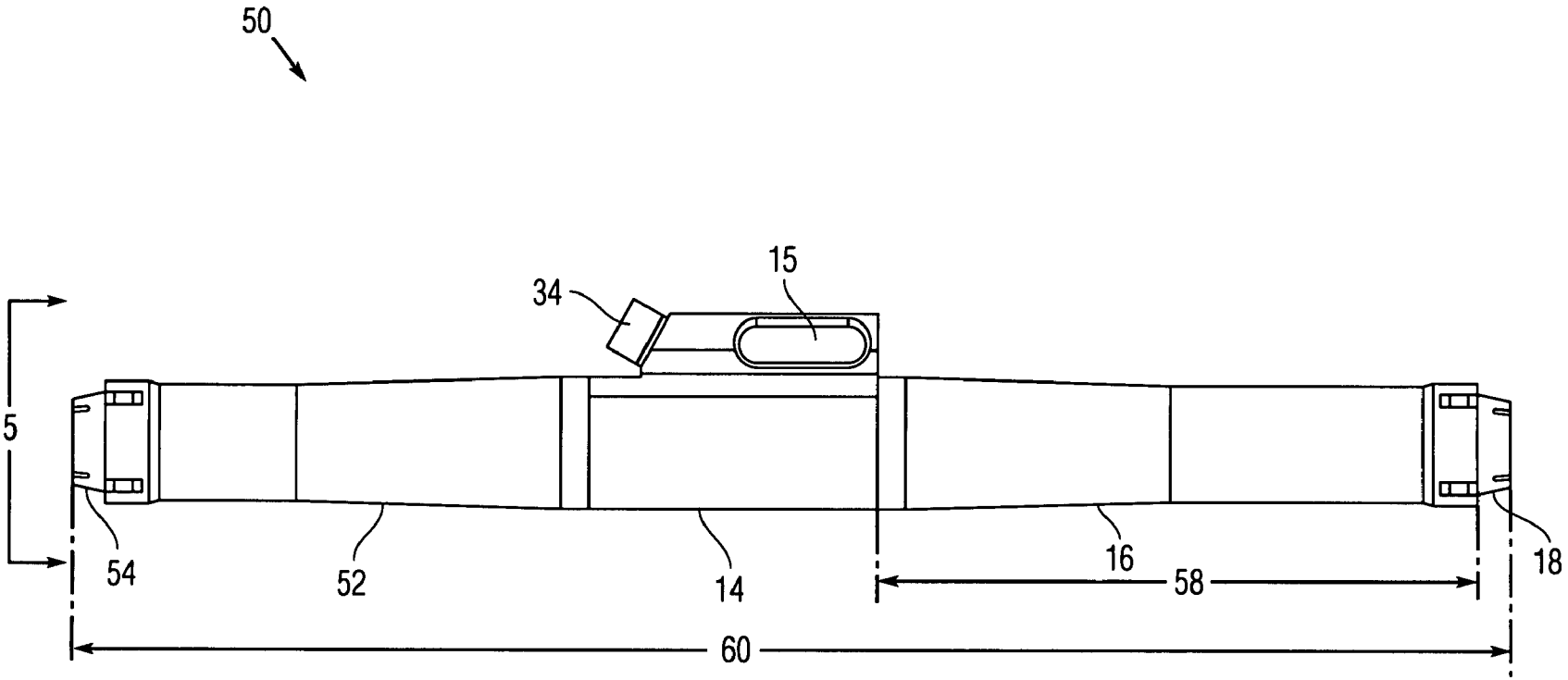
FIG. 4 is a side view of another embodiment of a water cannon in accordance with the present invention.
Figure 5:
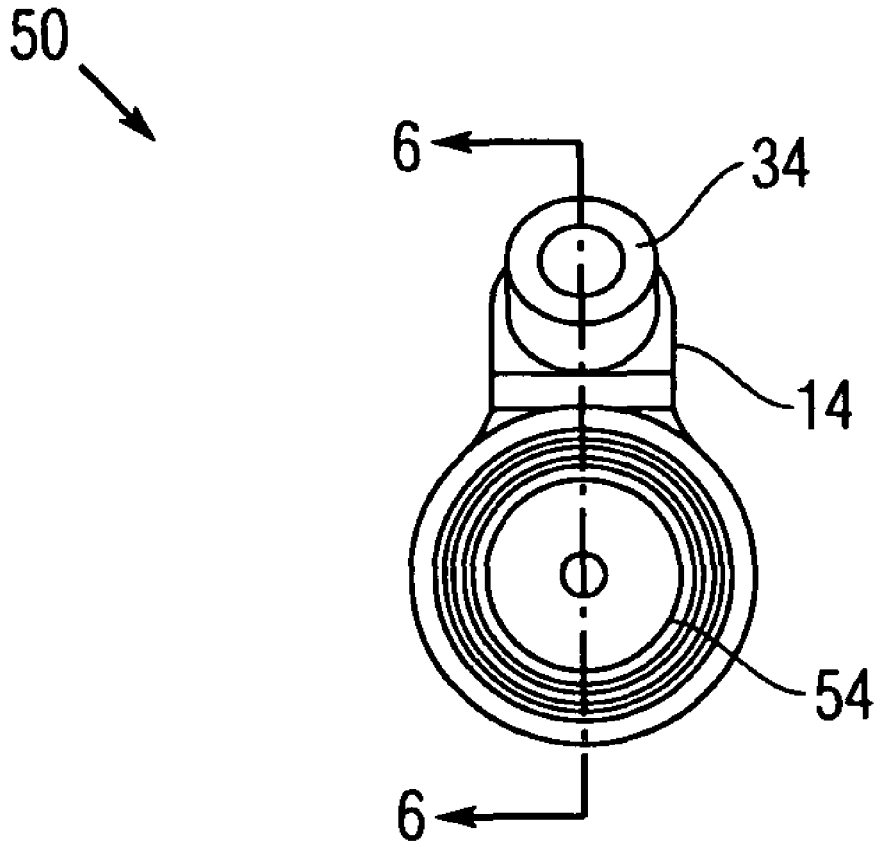
FIG. 5 is a view through line 5-5 of FIG. 4.

Referring to FIGS. 4 and 5, another exemplary embodiment of a water cannon 50 in accordance with the present invention is illustrated. As illustrated, this embodiment is a recoilless arrangement of the water cannon. In one embodiment, the recoilless arrangement is a reconfiguration of the recoil arrangement, and, therefore, many of the same members are used in both arrangements as indicated by the same reference numerals. In this embodiment, the water cannon includes a second barrel 51 extending from the breech block 14 in a second direction opposite the first direction of the first barrel 16. Attached to one end of the second barrel opposite the end attached to the breech block is a second nozzle 54. The overall length 60 of the recoilless arrangement of the water cannon is from about 40 to about 42 inches.

Figure 6:
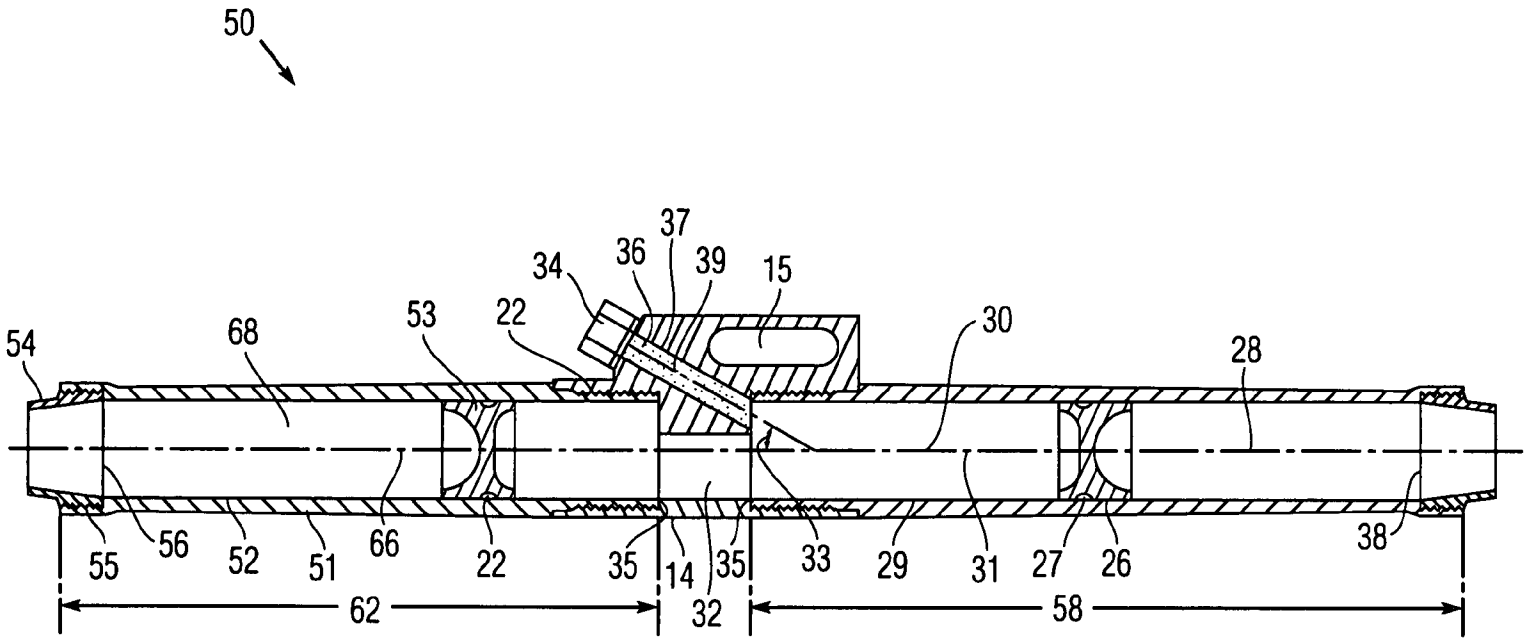
FIG. 6 is a view through line 6-6 of FIG. 5.

Referring to FIG. 6, the second barrel 51 includes a second cylindrical bore 52 that contains a second charge of water 68. The second cylindrical bore includes a second central axis 66 that is collinear with the first central axis 31 of the first barrel 16. Therefore, the first and second barrels, and in particular the central bores of these barrels, are aligned in opposite directions. In one embodiment, a second pusher plug assembly 53 is provided in the second barrel. Suitable materials and arrangements for the second pusher plug assembly are the same as for the first pusher plug assembly 26 in the first barrel. In addition, the second pusher plug assembly is disposed at a same distance along the second barrel as the first pusher plug assembly is disposed along the first barrel, taking into account the length or distance of the first barrel occupied by the chamber 30. In one embodiment, the second barrel is releasably attached to the breech block 14. In another embodiment, the second barrel is disposed within the opening 35 of the breech block and is in communication with the passage 32 in the breech block. Therefore, the chamber is in communication with the first and second cylindrical bores 29, 52, and the charge of energetic material, upon ignition, simultaneously expels the first and second charges of water 28, 68 from the first and second barrels. A two part mechanical fastener 55 is provided between the second nozzle 54 and the second barrel 51. The second barrel includes the first part of the two-part mechanical fastener, for example a threaded female fitting, and the second nozzle contains the corresponding second part, a male thread.

In one embodiment, the second barrel 51 is releasably attached to the opening 35 of the breech block 14 by a two-part mechanical fastener 22, in an exemplary embodiment, a threaded fastener. This two-part fastener can be the same two-part mechanical fastener that is used to attach the breech plug 12 to the opening. Therefore, the opening contains the first part, female threads, of the two part mechanical fastener, and both the breech plug and the second barrel contain corresponding second parts, male threads, of the mechanical fastener. Using this arrangement, the breech plug and the second barrel can be interchangeably attached to the opening. Therefore, the water cannon can be part of a water cannon system that includes the first barrel 16, the breech block, the breech plug and the second barrel. The interchangeability of the breech plug and the second barrel give the water cannon system to ability to be configured as either a recoil water cannon or a recoilless water cannon.

The simultaneous discharge of the first and second charges of water 28, 68 in opposite directions provides the force balance to make the water cannon recoilless. Therefore, the sizes of the first and second charges of water are preferably substantially the same. In one embodiment, this is accomplished by providing that the length of the first barrel 16, first length 58, is substantially the same as the length of the second barrel 51, second length 62. In this embodiment, the chamber 30 is disposed within the breech block 14. Alternatively, the length of the first barrel is greater than the length of the second barrel. In one embodiment, the length of the first barrel is about 20 inches, and the length of the second barrel is about 17 inches. In this embodiment, the chamber is disposed in the first barrel. The sizes of the first and second charges of water are equalized using the placement of the pusher plug assembly 26 within the first barrel. Therefore, the first and second pusher plug assemblies 26, 53 are placed within the first and second cylindrical bores 29, 52 at a location that provides for a chamber and that creates a first charge of water the same volume as the second charge of water.

In order to assemble the embodiment of the water cannon shown in FIGS. 4-6, the first pusher plug assembly 26 is placed in the first cylindrical bore 29 as the desired position, and the first charge of water 28 is added. The first diaphragm 35 is added to the end of the first barrel 16, and the first nozzle 18 is threaded onto the end of the first barrel to hold the diaphragm in place. The charge of energetic material is then added to the other end of the first barrel, and the first barrel is threaded onto the breech block 14. A second pusher plug assembly 53 is inserted into the second barrel 51. The second barrel is then filled with the second charge of water 68. The second diaphragm 56 is placed over the open end of the barrel, and the second nozzle 55 is threaded onto the second barrel to hold the second diaphragm in place. Then, the second barrel is threaded into the opening of the breech block. The ignition charge 36 is then added to the ignition charge port 37 of the breech block.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s). Therefore, it will be understood that the appended claims are intended to cover all such modifications and embodiments, which would come within the spirit and scope of the present invention.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of significant digits and by applying ordinary rounding.

What is claimed is:

1. A water cannon system comprising:

a breech block;

a first barrel being attached to the breech block and extending from the breech block in a first direction, the first barrel comprises a first cylindrical bore containing a first charge of water;

an opening being disposed in the breech block opposite the first barrel, the opening comprises a first part of a two part mechanical fastener;

a breech plug comprising a corresponding second part of the two part mechanical fastener;

a second barrel comprising the corresponding second part of the two part mechanical fastener; and a chamber being in communication with the first cylindrical bore and the opening in the breech block, the chamber sized to hold a charge of energetic material, wherein the breech plug and the second barrel are capable of being interchangeably attached to the opening.

2. The water cannon system of claim 1, wherein the two-part mechanical fastener comprises a threaded fastener.

3. The water cannon system of claim 2, wherein the opening in the breech block comprises a threaded female fitting, and wherein the breech plug and the second barrel each comprise a male threaded fitting.

4. The water cannon system of claim 1, wherein the second barrel when attached to the opening in the breech block extends from the breech block in a second direction substantially opposite the first direction, and wherein the second barrel comprises a second cylindrical bore containing a second charge of water.

5. The water cannon system of claim 1, further comprising an ignition charge port being disposed in the breech block and intersecting the chamber.

6. The water cannon of claim 5, wherein the ignition port intersects the chamber at an angle other than 90 degrees.

* * * * *